United States Patent [19]

Case

[11] Patent Number: 4,564,210

[45] Date of Patent: Jan. 14, 1986

[54] CROSS-COUNTRY SKI

[76] Inventor: Anthony R. Case, 518 Federal Ave., East, Seattle, Wash. 98102

[21] Appl. No.: 535,861

[22] Filed: Sep. 26, 1983

[51] Int. Cl.[4] ..... A63C 5/00

[52] U.S. Cl. ..... 280/604; 280/608

[58] Field of Search ..... 280/604, 608, 610, 809

[56] References Cited

U.S. PATENT DOCUMENTS

| | | | |
|---|---|---|---|
| 2,189,760 | 2/1940 | Matthee et al. | 280/11.13 |
| 2,287,252 | 6/1942 | Kaufmann | 280/11.13 |
| 3,178,194 | 4/1965 | Buchmuller | 280/11.13 |
| 3,980,312 | 9/1976 | Buttner | 280/610 |
| 4,083,577 | 4/1978 | Ford | 280/608 |
| 4,095,813 | 6/1978 | Hall | 280/604 |
| 4,148,500 | 4/1979 | Nidecker | 280/604 |
| 4,165,886 | 8/1979 | Nussbaumer | 280/604 |

FOREIGN PATENT DOCUMENTS

| | | | |
|---|---|---|---|
| 2110737 | 8/1972 | Fed. Rep. of Germany . | |
| 2428105 | 1/1976 | Fed. Rep. of Germany | 280/604 |
| 2301274 | 9/1976 | France . | |
| 200702 | 1/1939 | Switzerland | 280/604 |
| 525011 | 8/1972 | Switzerland | 280/604 |

*Primary Examiner*—David M. Mitchell
*Assistant Examiner*—Richard M. Camby
*Attorney, Agent, or Firm*—Robbins & Laramie

[57] ABSTRACT

The invention is a cross-country ski which is useful for ski mountaineering. The cross-country ski comprises a ski body having a longitudinal slot in its underface, metal edges extending below the underface, a climbing surface fixed in said longitudinal slot, a first fastening means fixed in said longitudinal slot, and a detachable running surface. The longitudinal slot preferably runs the entire length of the sliding sole, i.e., the sliding surface of the ski. The running surface has a second fastening means fixed on its backside and preferably an element of a third fastening means at its ends. In the latter case, an element of the third fastening means is also present on the ski body. The running surface covers the entire underface of the ski between the metal edges and fits flush with the metal edges.

9 Claims, 2 Drawing Figures

CROSS-COUNTRY SKI

BACKGROUND OF THE INVENTION

The present invention relates to a cross-country ski having a climbing surface fixed in a longitudinal slot, a detachable running surface, and fastening means for attaching the detachable running surface. The detachable running surface covers the length of the ski and is flush with the edges of the ski.

A wide variety of patterned ski bases are currently in use on cross-country skis. These are generically known as "no-wax" or "waxless" skis. Patterned ski bases or waxless skis are not widely used for ski mountaineering because the depth of the pattern necessary to facilitate steep climbing would overly increase gliding friction on the skier's descent.

However, detachable climbing skins are a class apart from patterned or waxless ski bases, and have been in use since the inception of skiing. Skis equipped with gripping devices such as sealskins or imitations thereof in synthetic materials applied to the soles of the skis are already known. The application of self-adhesive natural or synthetic skins has the disadvantage of imperfect adherence. Self-adhesive skins have a tendency to become soaked with water from many snow conditions which render their glue useless. Moreover, when removing the adhered skin, a part of the adhesive material may remain on the ski sole, thus preventing good sliding. In order to overcome this latter disadvantage, the sticking of strips of gripping skin in longitudinal grooves has already been suggested. This gives rise to another disadvantage, viz. the sole no longer provides a sufficiently large, smooth surface after the adhesive skin has been removed.

In an effort to eliminate these problems, inserts have recently been developed to provide a detachable climbing surface. Inserts for skis of this type normally comprise several layers, e.g., one layer comprising the means to prevent backward sliding (steps, scales, skin) on the side of the sliding surface, a supporting web, to which the above-mentioned layer is bonded and a band that is adhesive on both of its sides, one side being integrally joined to the supporting web, the other being the self-adhesive surface of the insert. As such an insert is of considerable thickness, a corresponding depth of the recess in the sliding sole of the ski is necessary. In order to achieve this, relatively thick sliding soles must be used, which in the case of cross-country skis is a disadvantage for weight reasons and/or the cost of the high-quality material for sliding soles. Otherwise, the recesses must extend into the body of the ski, thus impairing the supporting function of the lowest layer of the ski body on the one hand, and causing problems in the production on the other hand, as considerable tool wear is entailed when milling into the lowest supporting layer of the ski, which in the case of modern skis is almost exclusively made of glass-reinforced plastics. Milling also decreases the structural integrity of the ski section, resulting in a less durable ski. It is a further disadvantage that the sliding soles are conventionally produced of materials with poor adhesive qualities, e.g., polyethylene, so that the inserts are not sufficiently affixed to the recesses in such a sliding surface of polyethylene.

In addition, the fixing of permanent and undetachable gripping devices to ski soles is also known. These devices cause excessive resistance during downhill skiing and have a tendency to ice up under some conditions.

The disadvantages of the prior art are overcome by the present invention. The climbing surface is permanently attached to the ski but will not ice up. A detachable running surface is attached over the climbing surface for gliding.

SUMMARY OF THE INVENTION

The invention is a cross-country ski which is useful for ski mountaineering. The cross-country ski comprises a ski body having a longitudinal slot in its underface, metal edges extending below the underface, a climbing surface fixed in said longitudinal slot, a first fastening means fixed in said longitudinal slot, and a detachable running surface. The longitudinal slot preferably runs the entire length of the sliding sole, i.e., the sliding surface of the ski. The running surface has a second fastening means fixed on its backside and preferably an element of a third fastening means at its ends. In the latter case, an element of the third fastening means is also present on the ski body. The running surface covers the entire underface of the ski between the metal edges and fits flush with the metal edges.

The climbing surface may be a synthetic skin, a heavily patterned polyethylene material or any other substance which would provide suitable friction for climbing. The running surface may be a plastic which is smooth so that ski wax could be applied to it or a plastic which is patterned, as on waxless skis. Preferably, the plastic is polyethylene. The running surface also preferably contains a guide groove.

The first and second fastening means are selected so that they fasten one to the other. Examples include the two halves comprising Velcro®, magnets and male-female couplings. The first fastening means may be an integral part of the climbing surface such as a heavily patterned polyethylene. In this case, the second fastening means would interlock into the pattern. The third fastening means is preferably metal snaps.

DETAILED DESCRIPTION OF THE INVENTION

Figures 1, 2:
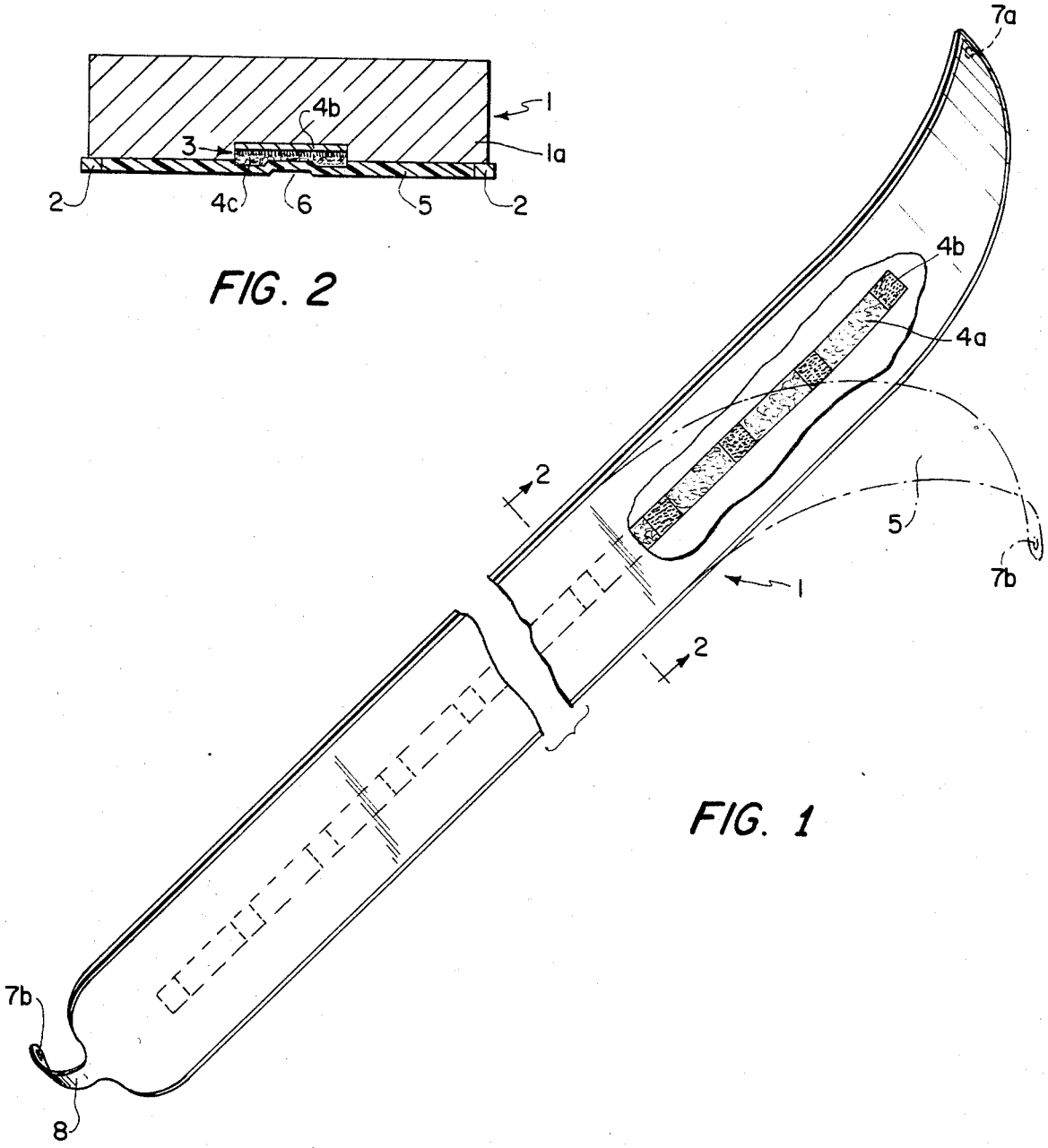
FIG. 1 is a plan view of the undersurface of the ski showing the running surface attached over a portion thereof.
FIG. 2 is a sectional view taken along line 2—2 of FIG. 1.

In the described embodiment, the ski 1 comprises a ski body 1*a* which contains metal edges 2 extending below the undersurface of the ski 1. The ski 1 may be made of any conventional material generally used for cross-country skis, and has been manufactured to contain a longitudinal slot 3 in the ski body 1*a*. The longitudinal slot 3 in the ski body 1*a*. The longitudinal slot 3 preferably extends through the entire distance of the sliding surface. A climbing surface 4*a* is permanently fixed in the longitudinal slot 3 by adhesive, or by being molded into the longitudinal slot, or by other suitable means. A synthetic fur skin may be used as a climbing surface 4*a*. A first fastening means 4*b* is also permanently fixed in the longitudinal slot 3. A suitable first fastening means 4*b* may be the pile side of a Velcro® strip. If the climbing surface 4*a* and first fastening means 4*b* are separate elements, they are preferably fixed in an alternate fashion in the longitudinal slot 3.

A running surface 5 is detachably fixed to the ski 1. The width of the running surface 5 is such that it fits closely between the metal edges 2 of the ski 1. The running surface 5 may be made of smooth polyethylene and preferably contains a guide groove 6. Other suitable materials may be used for the running surface 5. A second fastening means is permanently fixed to the backside of the running surface 5. It may be fixed by adhesive or by being molded with the climbing surface as one integral unit. If the pile side of a Velcro® strip is used as the first fastening means 4*b*, then the hook side of a Velcro® strip will be used as a second fastening means 4*c*. The first fastening means 4*b*, second fastening means 4*c* and running surface 5 are manufactured such that the undersurface of the running surface 5 is flush with the undersurface of the metal edges 2. A third fastening means is preferably utilized to secure the ends of the running surface to prevent creeping. The third fastening means comprises elements 7*a* and 7*b*. Element 7*a* is located at the forward tip of the undersurface of the ski 1 and on the rear backside of ski 1. Element 7*b* is fixed on the tip of the backside of the running surface 5 and on an extension 8 of the running surface 5. The elements of metal snaps are examples of elements 7*a* and 7*b*.

The climbing surface 4*a* and first fastening means 4*b* may be one integral element. An example of such an integral element is a heavily-patterened polyethylene material. If an integral element is used as the climbing surface and first fastening means, it may be molded into the longitudinal slot 3 during the manufacture of the ski body 1*a*. In this instance, the second fastening means would be fashioned to interlock with the integral climbing surface and first fastening means. Additional suitable first and second fastening means include magnets and male-female couplings such as snaps or a rib and groove pattern.

The running surface 5 may be smooth, in which case a ski wax can be utilized for gliding. Alternatively, the running surface can be molded to contain scales or other patterns which are conventionally used for waxless skis.

In a preferred embodiment, the longitudinal slot 3 molded into the underface of the ski 1 is 0.100 inch in depth. The first fastening means 4*b* and second fastening means 4*c* are 0.100 inch when fastened. The polyethylene running surface is 0.050 inch thick and fits flush with the undersurface of the metal edges.

In operation, the running surface 5 is removed from the ski 1 for climbing, and may simply be rolled up and stored until needed for a descent or for level skiing. The climbing surface 4*a* is then available for the ascent. In the latter two instances, the running surface 5 is secured to the ski 1 by the first fastening means 4*b*, the second fastening means on the backside of running surface 5 and the third fastening means comprising elements 7*a* and 7*b*. The third fastening means eliminates any creep that might occur as a result of front-to-rear loading during skiing. The close fit of the detachable running surface 5 to the metal edges 2 eliminates side-to-side movement of the base. The detachable running surface 5 may be detached and attached as often as necessary during the course of a tour. Although the climbing surface 4*a*, and the first fastening means 4*b* will not ice up, it may sometimes be necessary to brush loose snow away from the undersurface of the ski 1 before attaching the running surface 5.

The foregoing is considered as illlustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A cross-country ski comprising a ski body and a detachable running surface, said ski body having an underface with a longitudinal slot therein, metal edges having an underface and extending beneath said underface of said ski body and a climbing surface permanently fixed in said slot, and said running surface having an underface and a backside, said ski further comprising:

a first fastening means permanently fixed in said slot;

a second fastening means on the backside of said running surface;

a first element of a third fastening means on the underface of the ski body, and a second element of the third fastening means on the backside of the running surface;

said first and second fastening means cooperating to secure the running surface to the underface of the ski body and said third fastening means serving to prevent creeping of the running surface relative to the ski body.

2. The cross-country ski of claim 1 wherein said first element of said third fastening means is located at the forward tip of the underface of said ski body, and said ski further comprises an additional first element of said third fastening means on the rear backside of said ski body.

3. The cross-country ski of claim 2 wherein said second element of said third fastening means is located at the tip of the backside of said running surface, and said ski further comprises an additional second element of said third fastening means on an extension of said running surface.

4. The cross-country ski of claim 1 wherein said running surface when attached fits closely between said metal edges and flush with the underface of said metal edges.

5. The cross-country ski of claim 3 wherein said running surface when attached fits closely between said metal edges and flush with the underface of said metal edges.

6. The cross-country ski of claim 1 wherein said running surface has a guide groove in the underface of said running surface.

7. The cross-country ski of claim 3 wherein said running surface has a guide groove in the underface of said running surface.

8. The cross-country ski of claim 5 wherein said running surface has a guide groove in the underface of said running surface.

9. The cross-country ski of claim 8 wherein said climbing surface is synthetic fur skin and said running surface is a smooth polyethylene running surface.

* * * * *